US010517390B2

(12) United States Patent
Xiang et al.

(10) Patent No.: US 10,517,390 B2
(45) Date of Patent: Dec. 31, 2019

(54) ELEVATION WORKING PLATFORM

(71) Applicant: Loctek Inc., Fremont, CA (US)

(72) Inventors: Lehong Xiang, Ningbo (CN); Xiangming Zheng, Ningbo (CN); Tao Lin, Ningbo (CN); Fangyuan Li, Ningbo (CN)

( * ) Notice: Subject to any disclaimer, the term of this patent is extended or adjusted under 35 U.S.C. 154(b) by 0 days.

(21) Appl. No.: 15/865,255

(22) Filed: Jan. 9, 2018

(65) Prior Publication Data

US 2018/0125227 A1 May 10, 2018

Related U.S. Application Data

(63) Continuation of application No. PCT/CN2016/095619, filed on Aug. 17, 2016.

(30) Foreign Application Priority Data

Sep. 18, 2015 (CN) ..... 2015 2 0728687 U
May 31, 2016 (CN) ..... 2016 1 0378869

(51) Int. Cl.
*A47B 9/00* (2006.01)
*A47B 9/02* (2006.01)
(Continued)

(52) U.S. Cl.
CPC ..... *A47B 9/02* (2013.01); *A47B 9/10* (2013.01); *A47B 9/14* (2013.01); *A47B 9/16* (2013.01);
(Continued)

(58) Field of Classification Search
CPC .... A47B 9/02; A47B 9/10; A47B 9/14; A47B 9/16; A47B 9/18; A47B 2009/145
See application file for complete search history.

(56) References Cited

U.S. PATENT DOCUMENTS 3,282,566 A * 11/1966 Clarke ..... A47B 9/18 254/122
4,273,306 A * 6/1981 Chang ..... A47B 9/16 108/145
(Continued)

FOREIGN PATENT DOCUMENTS

CN 201205081 Y 3/2009
CN 204541230 U 8/2015
(Continued)

OTHER PUBLICATIONS

English translation of Weritz (DE3608231) (Year: 2019).*
(Continued)

*Primary Examiner* — Matthew W Ing
(74) *Attorney, Agent, or Firm* — W&K IP

(57) ABSTRACT

An elevation working platform includes a lower support and an upper support. At least one group of X-type elevation mechanisms is provided between the lower support and the upper support. The elevation working platform further includes an elastic element. A first end of the elastic element is connected between two end points of a first support rod or a second support rod. A second end of the elastic element is connected to the lower support or a second hinging seat capable of sliding relative to the lower support. Using the X-type elevation mechanisms, the front and back positions of the upper support do not change in an elevating process of the upper support, the structure is simple and practical, and the cost is relatively low.

16 Claims, 15 Drawing Sheets

(51) Int. Cl.

| | |
|---|---|
| ***A47B 9/16*** | (2006.01) |
| ***A47B 21/02*** | (2006.01) |
| ***A47B 9/14*** | (2006.01) |
| ***A47B 21/04*** | (2006.01) |
| ***A47B 97/00*** | (2006.01) |
| ***A47B 9/10*** | (2006.01) |
| *A47B 13/16* | (2006.01) |
| *A47B 3/02* | (2006.01) |

(52) U.S. Cl.

CPC ..... *A47B 21/02* (2013.01); *A47B 21/04* (2013.01); *A47B 97/00* (2013.01); *A47B 13/16* (2013.01); *A47B 2003/025* (2013.01); *A47B 2097/006* (2013.01); *A47B 2200/005* (2013.01); *A47B 2200/0085* (2013.01)

(56) References Cited

U.S. PATENT DOCUMENTS

| | | | | | |
|---|---|---|---|---|---|
| 5,400,720 | A * | 3/1995 | Stevens | A47B 9/16 | 108/147 |
| 5,632,209 | A * | 5/1997 | Sakakibara | A47B 9/02 | 108/145 |
| 5,649,493 | A * | 7/1997 | Blume | A47B 9/00 | 108/136 |
| 9,326,598 | B1 * | 5/2016 | West | A47B 3/02 | |
| 2013/0340655 | A1 * | 12/2013 | Flaherty | A47B 9/18 | 108/96 |
| 2014/0360414 | A1 * | 12/2014 | Gillotti | A47B 9/18 | 108/90 |
| 2015/0289641 | A1 * | 10/2015 | Ergun | A47B 9/16 | 108/42 |
| 2018/0055214 | A1 * | 3/2018 | Kim | A47B 9/10 | |

FOREIGN PATENT DOCUMENTS

| | | | | |
|---|---|---|---|---|
| CN | 105124920 | A | 12/2015 | |
| CN | 204949970 | U | 1/2016 | |
| CN | 105901942 | A | 8/2016 | |
| DE | 3608231 | A1 * | 9/1987 | A47B 9/16 |
| DE | 4032674 | A1 | 4/1992 | |
| DE | 20317442 | U1 | 4/2004 | |
| KR | 20080005702 | A | 1/2008 | |

OTHER PUBLICATIONS

English translation of Huang (CN204541230) (Year: 2019).*

International Search Report of PCT/CN2016/095619 dated Nov. 4, 2016.

* cited by examiner

ELEVATION WORKING PLATFORM

CROSS-REFERENCE TO RELATED APPLICATIONS

This application a continuation of International Patent Application No. PCT/CN20161095619 with a filing date of Aug. 17, 2016, designating the United States, now pending, and further claims priority to Chinese Patent Application No. 201520728687.0 with a filing date of Sep. 18, 2015 and No. 201610378869.9 with a filing date of May 31, 2016. The content of the aforementioned applications, including any intervening amendments thereto, are incorporated herein by reference.

TECHNICAL FIELD

The present disclosure relates to the field of tablet computer support, and more particularly, to an elevation working platform.

BACKGROUND OF THE PRESENT INVENTION

Tablet displays, tablet computers, etc., and associated supports are becoming increasingly popular in common families along with the developing of the society. An elevation working platform to support a tablet computer is typically disposed on a table or a desk in prior arts. Existing elevation working platforms provide a lifting resilience mostly through a mechanical spring or a torsion spring. A structure using support rods is typically utilized to enable the ascending or descending motion of the desk relative to an upper holder. The structure is complicated, and adjustment of the height of the desk may be bothering.

SUMMARY OF PRESENT INVENTION

A technical problem to be solved by the present disclosure is to provide an elevation working platform with a simple structure and convenient height adjustment.

The technical solution of the present disclosure is to provide an elevation working platform comprising an elevation working platform body. The elevation working platform body having an upper support, a lower support and at least one group of X-shaped elevating components connected between the upper support and the lower support. Each group of X-shaped elevating components comprises a first support rod and a second support rod hinged to a central portion of each other to form an X-shape. The lower support comprises a first hinging seat fixedly connected thereto and a second hinging seat slidable relative to the lower support. The upper support comprises a third hinging seat fixedly connected thereto and a fourth hinging seat slidable relative to the upper support. A lower end of the first support rod is hinged to the first hinging seat. An upper end of the first support rod is hinged to the fourth hinging seat. A lower end of the second support rod is hinged to the second hinging seat. An upper end of the second support rod is hinged to the third hinging seat. The elevation working platform comprises an elastic component. A first end of the elastic component is connected between the two endpoints of the first support rod or the second support rod. A second end of the elastic component is connected to the lower support or the second hinging seat slidable relative to the lower support, and the elastic component bears at least a part of the weight of the upper support.

By employing the above structure, the elevation working platform has the following advantages compared to prior arts. The elevation working platform provides a support force by an elastic component to bear the weight of the upper support or bear a part of the weight of the upper support. Therefore the working platform can be held at any height with the benefit of a simple structure, a convenient height adjustment and a lower cost. Since the lateral position of the upper support would not be altered as the upper support moves vertically, the elevation working platform is considerably practical.

The elastic component is arranged between the lower support and the first support rod, the first end of the elastic component is hinged to the lower support, and the second end of the elastic component is hinged to the first support rod.

In some embodiments, the elastic component is arranged between the second hinging seat and the second support rod. The first end of the elastic component is hinged to the second hinging seat, and the second end of the elastic component is hinged to the second support rod.

In some embodiments, the elastic component is a compressed gas spring or a compressed mechanical spring.

In some embodiments, the elastic component is arranged between the lower support and the second support rod. The first end of the elastic component is hinged to the lower support, and the second end of the elastic component is hinged to the second support rod.

In some embodiments, the elastic component is arranged between the second hinging seat and the first support rod. The first end of the elastic component is hinged to the second hinging seat, and the second end of the elastic component is hinged to the first support rod.

In some embodiments, the elastic component is a stretch gas spring or a tension spring.

In some embodiments, a locking component to restrict the sliding of the second hinging seat is arranged on the lower support.

In some embodiments, the locking component arranged on the lower support to restrict the sliding of the second hinging seat comprises a first sliding rail connected to the lower support. The second hinging seat is slidably fitted on the first sliding rail. A plurality of positioning holes are arranged along a lengthwise direction on the second hinging seat. A box body is arranged on the lower support outside the second hinging seat. A movable pin having a free end to be inserted into or removed from the positioning holes is arranged in the box body, and a sliding plate to actuate the movable pin and remove the free end of the movable pin from the positioning holes is slidably fitted in the box body. As the locking component is operated, the sliding plate is pulled to slide within the box body. The sliding plate actuates the movable pin and removes the free end of the movable pin from the positioning holes. At this moment, the second hinging seat slides along the first sliding rail to adjust the height of the X-shaped elevating components. After the upper support ascends or descends to a certain height, the sliding plate is released and the free end of the movable pin is once again inserted into the positioning holes to restrict sliding of the second hinging seat.

In some embodiments, a locking component to restrict the sliding of the fourth hinging seat is arranged on the upper support.

The locking component can lock the X-shaped elevating components so as to fix the height of the desk plate of the X-shaped elevating component. The weight-bearing capabilities of the elevation working platform would be improved. The elastic force of the elastic components is surmounted by a hand to adjust the height of the upper support when the locking component is opened. After the height of the upper support has been adjusted, the locking component is released to restrict the sliding of the fourth hinging seat and lock up the X-shaped elevating components. Therefore, the elevation working platform has a simple structure and convenient height adjustment.

In some embodiments, the locking component arranged on the upper support to restrict the sliding of the fourth hinging seat comprises a second sliding rail connected to the upper support. The fourth hinging seat is slidably fitted on the second sliding rail, a plurality of positioning holes are arranged along a lengthwise direction on the fourth hinging seat. A box body is arranged on the upper support outside the fourth hinging seat. A movable pin having a free end to be inserted into or removed from the positioning holes is arranged in the box body, and a sliding plate to actuate the movable pin and remove the free end of the movable pin from the positioning holes is slidably fitted in the box body. As the locking component is operated, the sliding plate is pulled to slide within the box body. The sliding plate actuates the movable pin and removes the free end of the movable pin from the positioning holes. At this moment, the fourth hinging seat slides along the second sliding rail to adjust the height of the X-shaped elevating components. After the upper support ascends or descends to a certain height relative to the lower support, the sliding plate is released and the free end of the movable pin is once again inserted into the positioning holes to restrict sliding of the fourth hinging seat.

In some embodiments, a movable pin seat is in clearance fit within the box body. The movable pin is connected to the movable pin seat. A reset spring is arranged on the movable pin. An end of the reset spring is in contact with an inner wall of the movable pin seat. The other end of the reset spring is in contact with an inner wall of the box body. The free end of the movable pin is removed from the positioning holes when the reset spring is compressed. A first guiding slope is provided on the bottom of the movable pin seat. A second guiding slope fitted to the first guiding slope is arranged on the sliding plate, and the second guiding slope extrudes the first guiding slope to move the movable pin seat outwards against the resilience of the reset spring when the sliding plate slides to the outside of the box body. When pulling the sliding plate to slide within the box body, the second guiding slope pushes the first guiding slope on the bottom of the movable pin seat and causes the movable pin seat to move outwards against the resilience of the reset spring. At this moment, the free end of the movable pin on the movable pin seat is removed from the positioning holes, and the second hinging seat slides along the first sliding rail, or alternatively, the fourth hinging seat slides along the first sliding rail, to adjust the height of the upper support. After the height of the upper support has been adjusted to a certain degree, the sliding plate is released to reset the movable pin by the reset spring and restrict the sliding of the second and fourth hinging seat by inserting the free end of the movable pin into the positioning holes. Simultaneously, the first guiding slope of the movable pin seat pushes the second guiding slope to reset the sliding plate.

A dragline is connected on an outer end of the sliding plate. A dragline reset spring is arranged on the dragline. An end of the dragline reset spring is in contact with a side wall of the outer end of the sliding plate. The other end of the dragline reset spring is in contact with the inner wall of the box body. A lever is connected to the upper support, and the lever is connected to the outer end of the dragline.

In some embodiments, the at least one group of X-shaped elevating components comprises two groups of X-shaped elevating components arranged on two sides of the upper support, and the two groups of X-shaped elevating components are connected by a horizontal plate. The structure allows synchronized movement of the X-shaped elevating components on the two sides of the upper support, as well as enhanced mechanical strength and stability.

In some embodiments, a desk plate is connected to the upper support.

In some embodiments, the elevation working platform body comprises a keyboard holder connected to the upper support by a connecting plate.

REFERENCE NUMBERS

Figure 1:
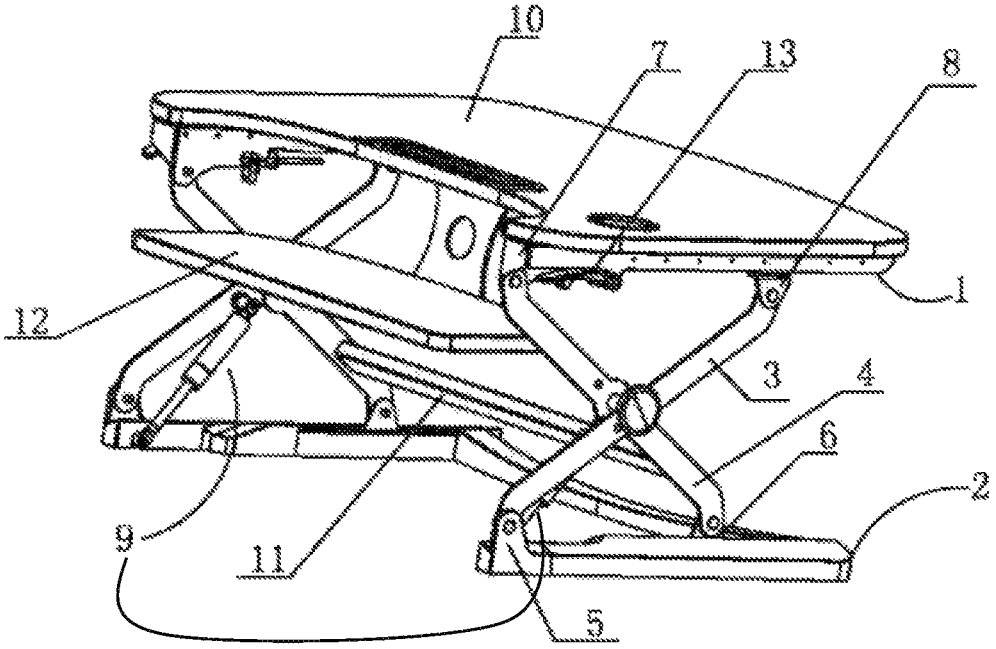
FIG. 1 is a structural schematic of an elevation working platform according to a first embodiment.
Figure 2:
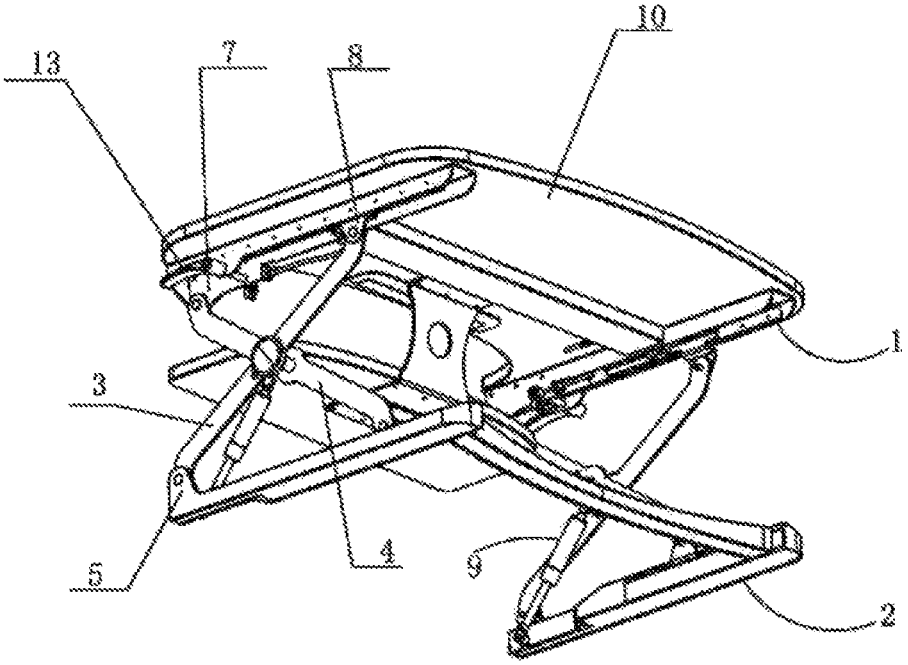
FIG. 2 is a structural schematic of the bottom of an elevation working platform according to a first embodiment.

1 upper support, 2 lower support, 3 first support rod, 4 second support rod, 5 first hinging seat, 6 second hinging seat, 7 third hinging seat, 8 fourth hinging seat, 9 elastic component, 9.1 gas spring, 9.2 spring, 10 desk plate, 11 horizontal plate, 12 keyboard holder, 13 lever, 14 first sliding rail, 15 second sliding rail, 16 positioning holes, 17 movable pin. 18 box body, 19 dragline reset spring, 20 reset spring, 21 movable pin seat, 22 first guiding slope, 23 sliding plate, 24 second guiding slope.

DETAILED DESCRIPTION OF PREFERRED EMBODIMENTS

Detailed description of the present disclosure is provided hereinafter in combination with the accompanying figures and embodiments.

As shown in FIG. 1-9, an elevation working platform of the present disclosure comprises an elevation working platform body. The elevation working platform body having an upper support 1, a lower support 2 and at least one group of X-shaped elevating components connected between the upper support 1 and the lower support 2. Each group of X-shaped elevating components comprises a first support rod 3 and a second support rod 4 hinged to a central portion of each other in an X-shaped fashion. The lower support 2 comprises a first hinging seat 5 fixedly connected to the lower support 2 and a second hinging seat 6 slidable relative to the lower support 2. The upper support 1 comprises a third hinging seat 7 fixedly connected to the upper support 1 and a fourth hinging seat 8 slidable relative to the upper support 1. A lower end of the first support rod 3 is hinged to the first hinging seat 5. An upper end of the first support rod 4 is hinged to the fourth hinging seat 8. A lower end of the second support rod 4 is hinged to the second hinging seat 6. An upper end of the second support rod 4 is hinged to the third hinging seat 7. The elevation working platform comprises an elastic component 9. A first end of the elastic component 9 is connected between the two endpoints of the first support rod 3 or the second support rod 4. A second end of the elastic component 9 is connected to the lower support 2 or the second hinging seat 6 slidable relative to the lower support, 2 and the elastic component 9 bears at least a part of the weight of the upper support.

During vertical movement of the upper support 1, the second hinging seat 6 and the fourth hinging seat 8 are slidable relative to the lower support 2 and the upper support 1 respectively, such that the X-shaped elevating components can be adjusted to lift or lower the upper support 1.

Figure 3:
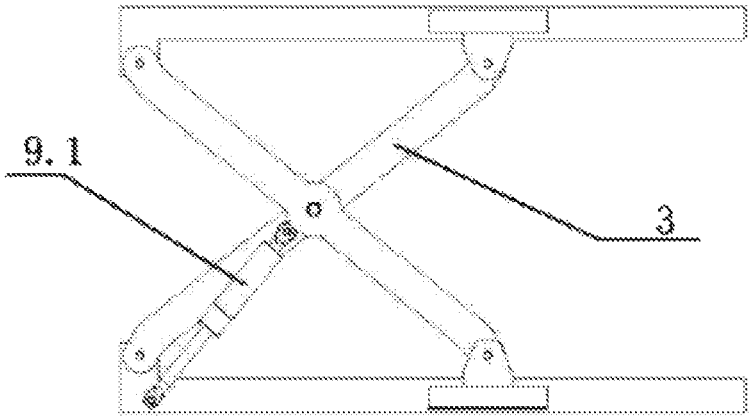
FIG. 3 is a structural schematic of an elevation working platform according to a second embodiment.

FIG. 3 refers to a second embodiment in which the elastic component 9 is a gas spring 9.1. A first end of the gas spring 9.1 is connected between the two endpoints of the first support rod 3. A second end of the gas spring 9.1 is connected to the lower support 2. The gas spring 9.1 in the embodiment is a compressed gas spring which provides an upward elastic force.

Figure 4:
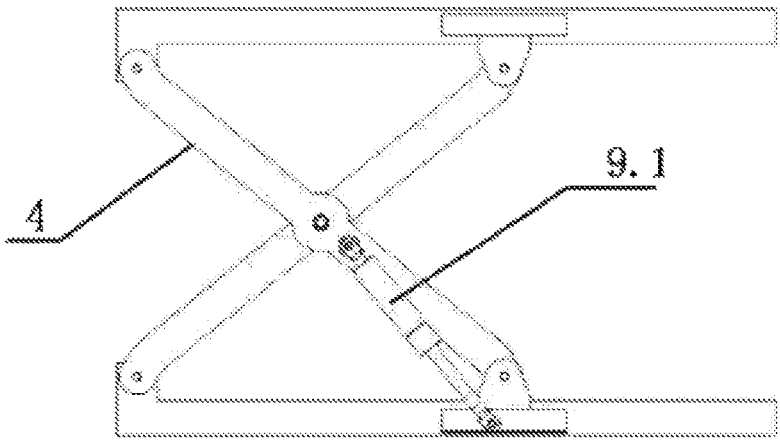
FIG. 4 is a structural schematic of an elevation working platform according to a third embodiment.

FIG. 4 refers to a third embodiment in which the elastic component 9 is a gas spring 9.2. A first end of the gas spring 9.2 is connected between the two endpoints of the second support rod 4. A second end of the gas spring 9.2 is connected to the second hinging seat 5. The gas spring 9.2 in the embodiment is a compressed gas spring which provides an upward elastic force.

Figure 5:
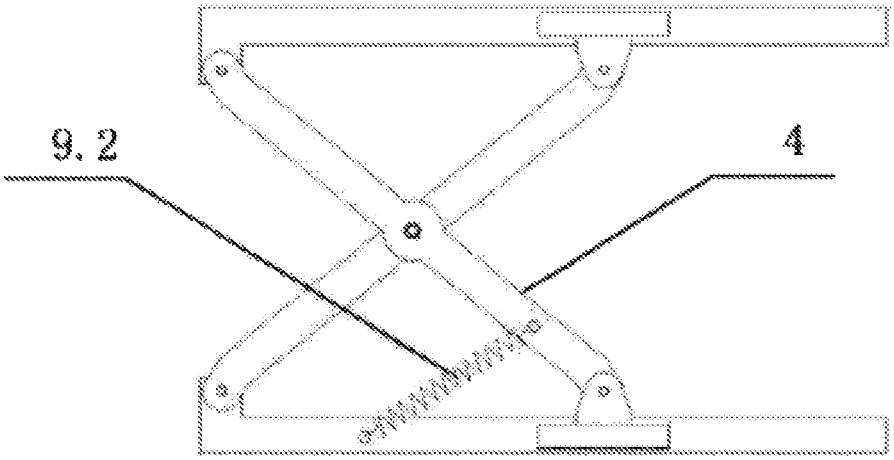
FIG. 5 is a structural schematic of an elevation working platform according to a fourth embodiment.

FIG. 5 refers to a fourth embodiment in which the elastic component 9 is a spring 9.2. A first end of the gas spring 9.2 is connected between the two endpoints of the second support rod 4. A second end of the gas spring 9.2 is connected to the lower support 2. The gas spring 9.2 in the embodiment is a tension spring which provides a contractive tension.

Figure 6:
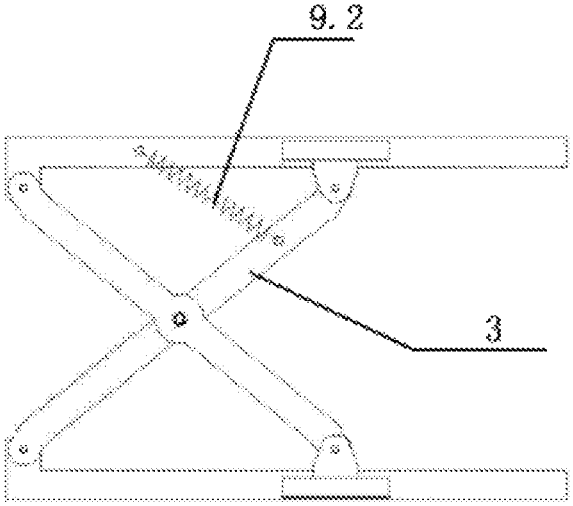
FIG. 6 is a structural schematic of an elevation working platform according to a fifth embodiment.

FIG. 6 refers to a fifth embodiment in which the elastic component 9 is a spring 9.2. A first end of the gas spring 9.2 is connected between the two endpoints of the first support rod 3. A second end of the gas spring 9.2 is connected to the upper support 1. The gas spring 9.2 in the embodiment is a tension spring which provides a contractive tension. This embodiment actually has a similar structure to the fourth embodiment and it is symmetrical to the fourth embodiment. The upper support 1 of this embodiment can be taken as the lower support 2 of the fourth embodiment. The structures of this embodiment are identical to the fourth embodiment if the first support rod 3 of this embodiment is taken as the second support rod 4 in the fourth embodiment. The symmetrical structure of the fourth embodiment is also within the scope of the present disclosure.

Figure 7:
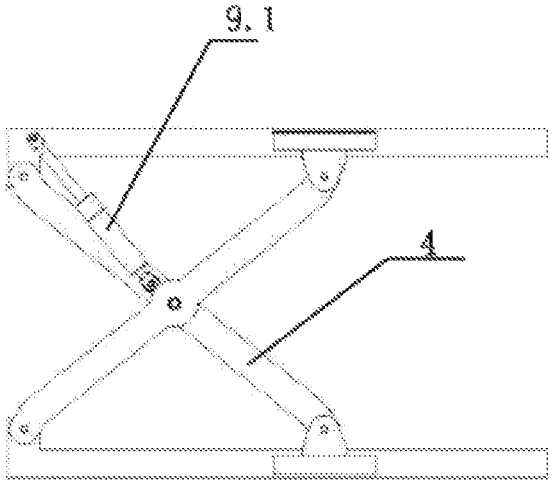
FIG. 7 is a structural schematic of an elevation working platform according to a sixth embodiment.

FIG. 7 is a sixth embodiment which is symmetrical to the second embodiment.

Figure 8:
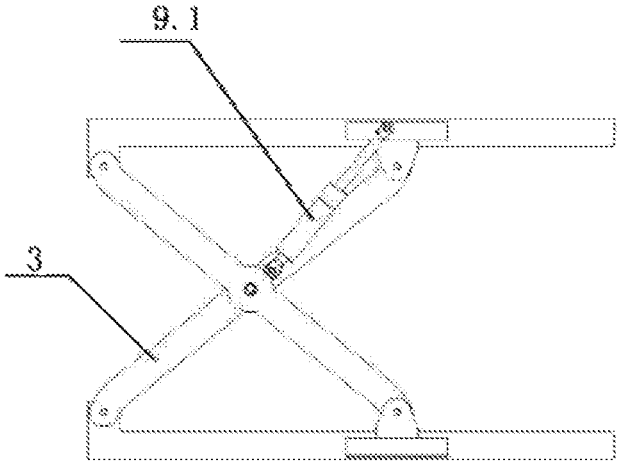
FIG. 8 is a structural schematic of an elevation working platform according to a seventh embodiment.

FIG. 8 is a seventh embodiment which is symmetrical to the third embodiment.

Embodiments of the present disclosure are not limited to the embodiments listed above.

Figure 9:
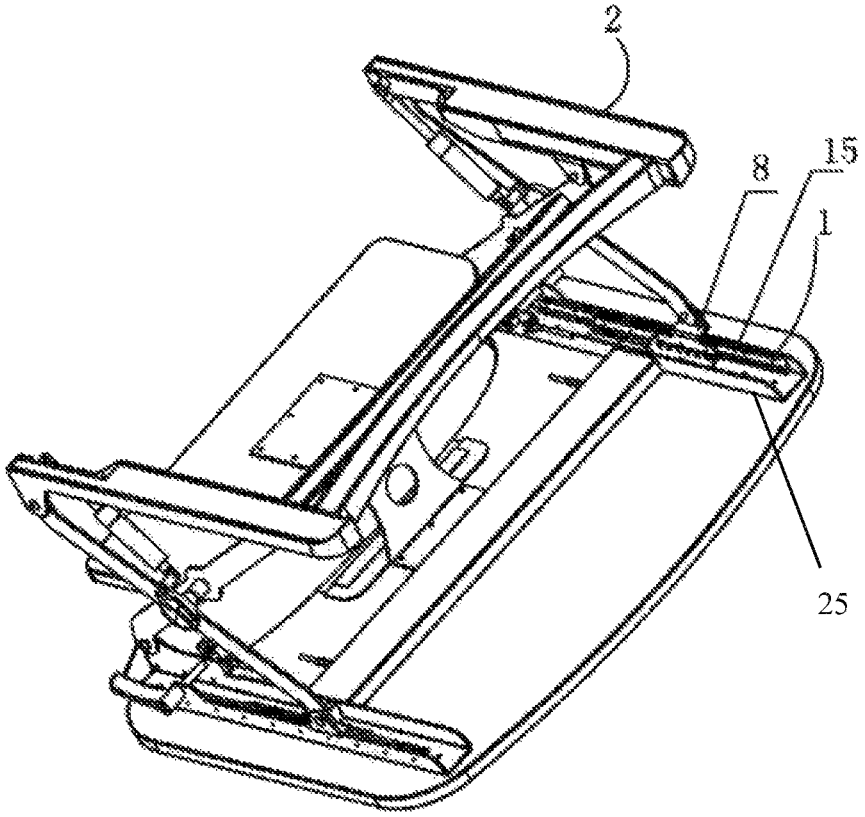
FIG. 9 is a structural schematic of a locking component of an elevation working platform according to an embodiment.
Figure 10:
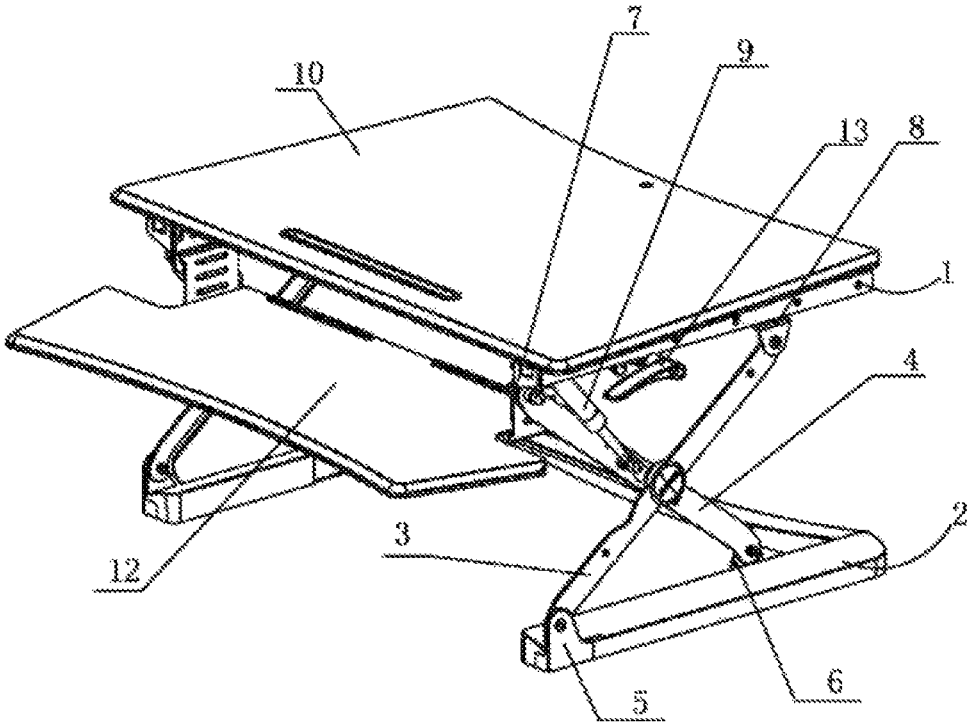
FIG. 10 is a structural schematic of an elevation working platform according to an eighth embodiment.
Figure 11:
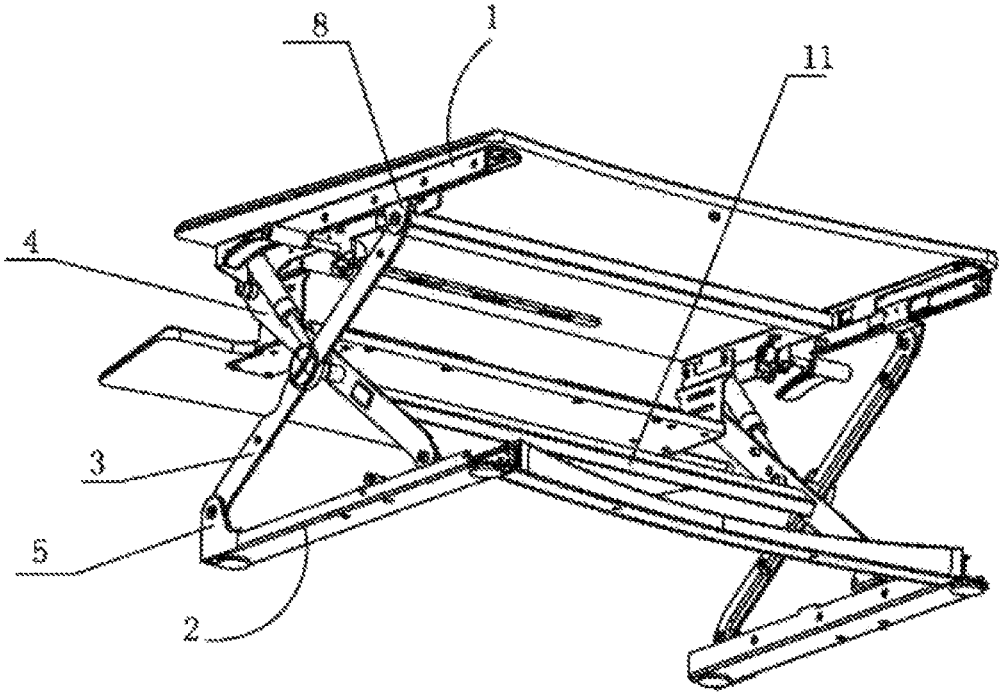
FIG. 11 is a structural schematic of the bottom of an elevation working platform according to the eighth embodiment.
Figure 12:
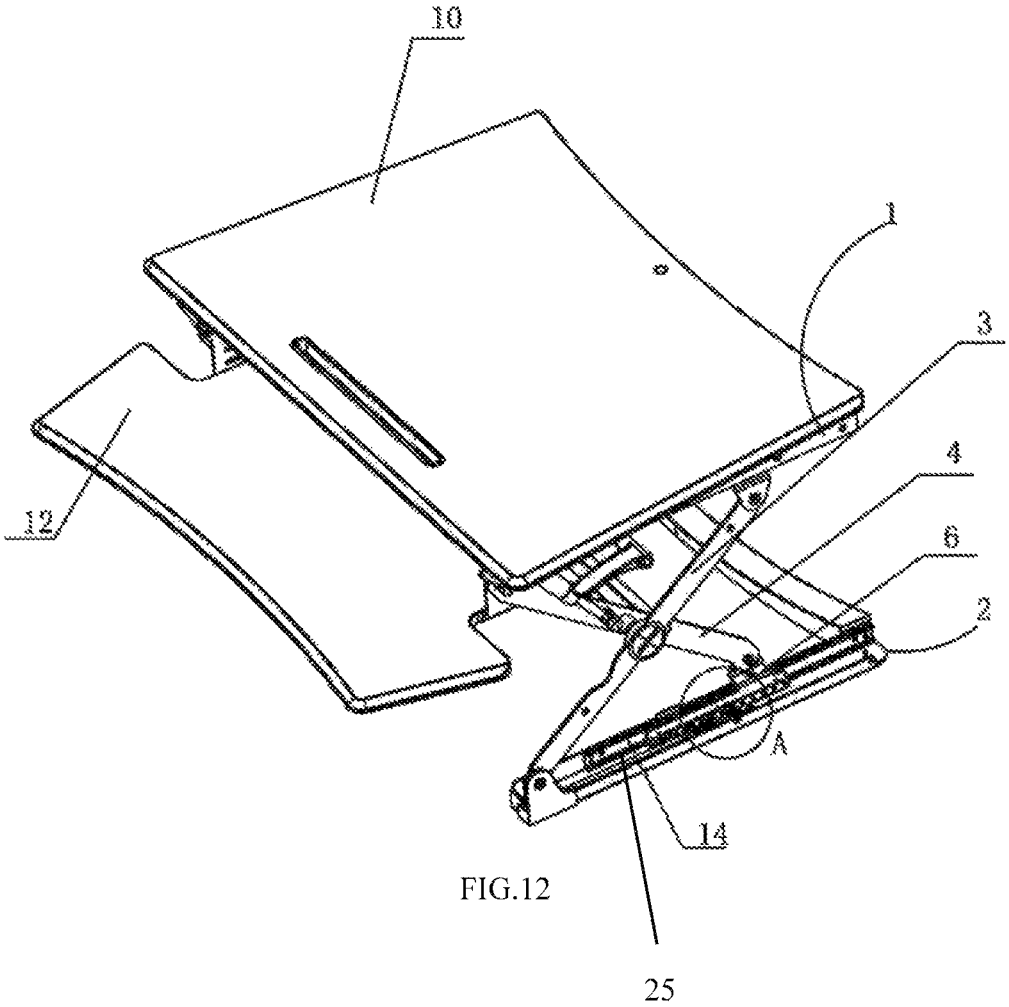
FIG. 12 is a structural schematic of a locking component of an elevation working platform according to the eighth embodiment.
Figure 13:
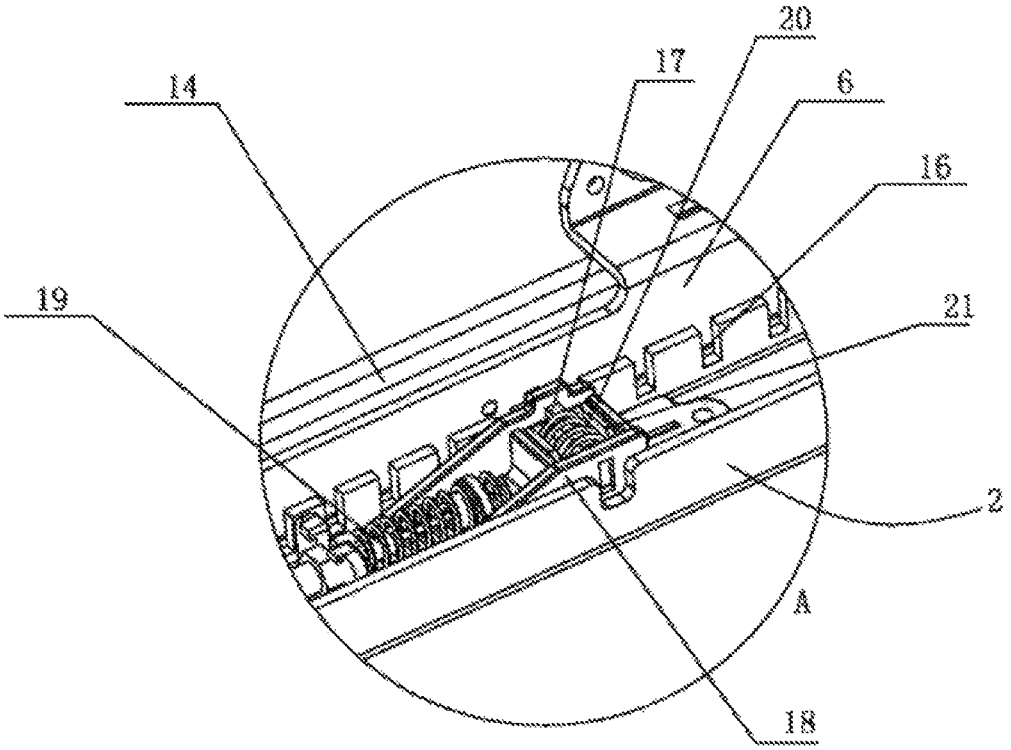
FIG. 13 is an enlarged view of a part A of the eighth embodiment of the elevation working platform in FIG. 12.
Figure 14:
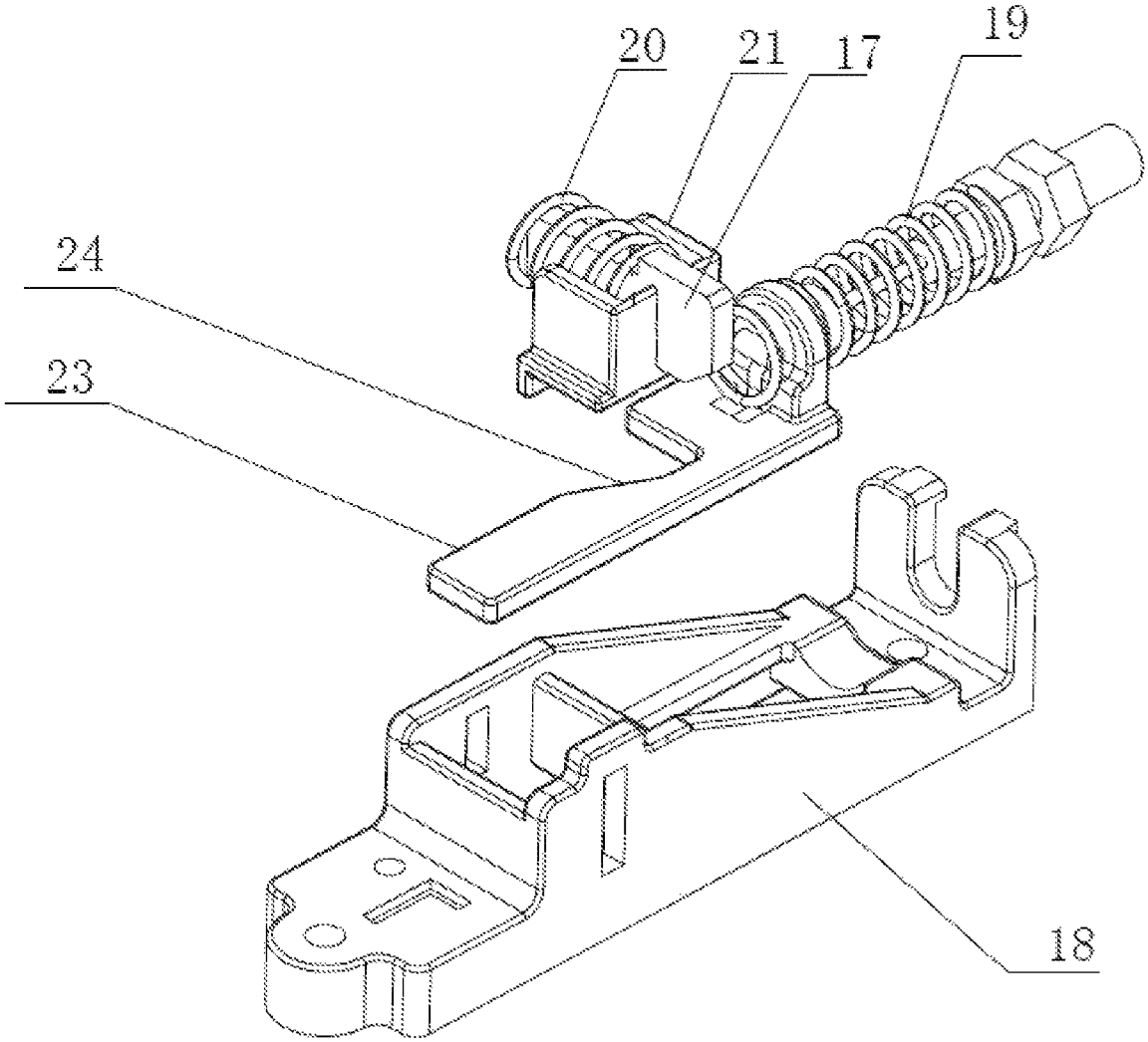
FIG. 14 is an assembled structural schematic of a locking component of an elevation working platform according to an embodiment.
Figure 15:
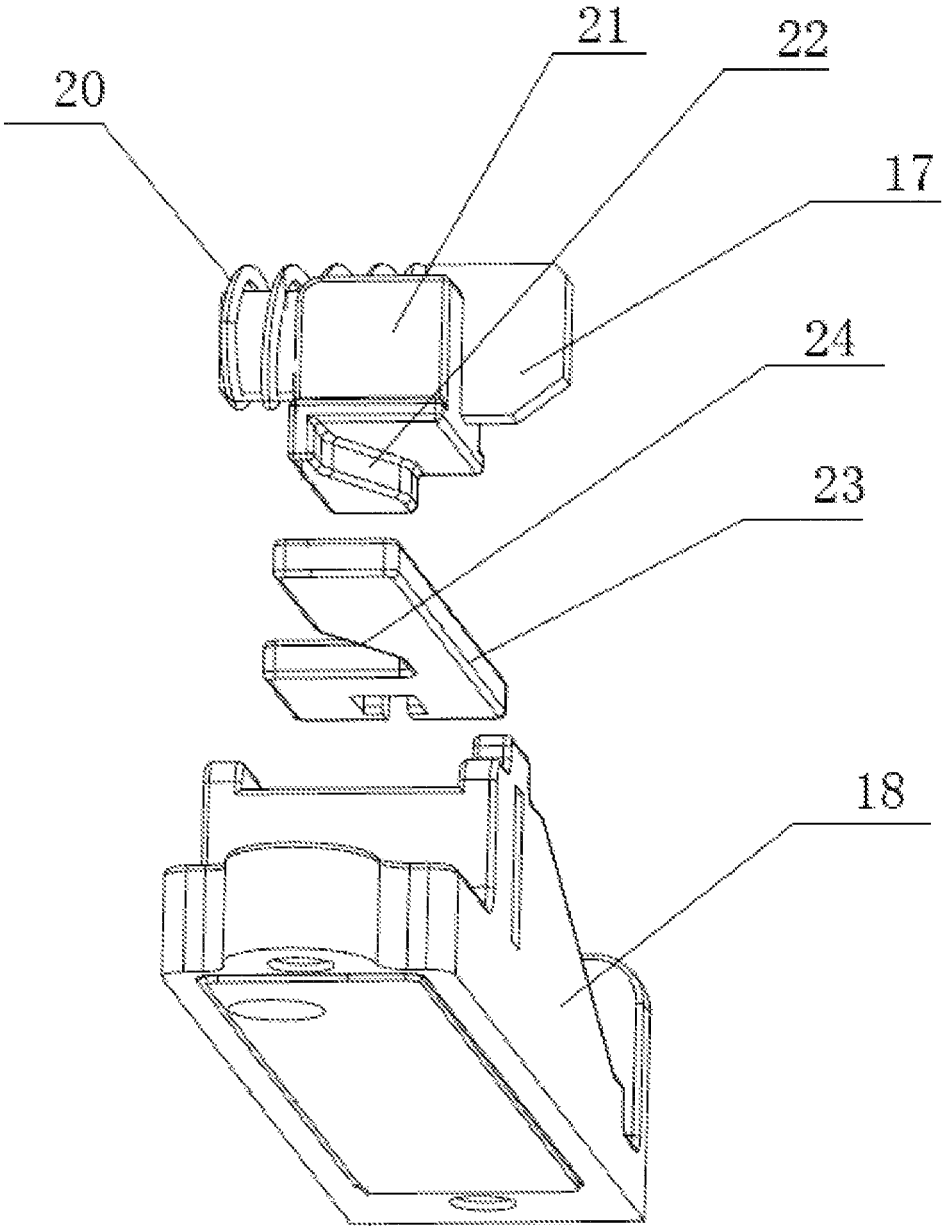
FIG. 15 is another perspective of an assembled structural schematic of a locking component of an elevation working platform according to an embodiment.

In the first embodiment as shown in FIGS. 9, 14 and 5, a locking component 25 to restrict the sliding of the fourth hinging seat 8 is arranged on the upper support 1. The locking component 25 arranged on the upper support 1 to restrict the sliding of the fourth hinging seat 8 comprises a second sliding rail 15 connected to the upper support 1. The fourth hinging seat 8 is slidably fitted on the second sliding rail 15. A plurality of positioning holes 16 are arranged along a lengthwise direction on the fourth hinging seat 8. A box body 18 is arranged on the upper support 1 outside the fourth hinging seat 8. A movable pin 17 having a free end to be inserted into or removed from the positioning holes 16 is arranged in the box body 18, and a sliding plate 23 to actuate the movable pin 17 and remove the free end of the movable pin 17 from the positioning holes 16 is slidably fitted in the box body 18.

A movable pin seat 21 is in clearance fit within the box body 18. The movable pin 17 is connected to the movable pin seat 21. A reset spring 20 is arranged on the movable pin 17. An end of the reset spring 20 is in contact with an inner wall of the movable pin seat 21. The other end of the reset spring 20 is in contact with an inner wall of the box body 18. The free end of the movable pin 17 is removed from the positioning holes 16 on the fourth hinging seat 8 when the reset spring 20 is compressed. A first guiding slope 22 is provided on the bottom of the movable pin seat 21. A second guiding slope 24 fitted to the first guiding slope 22 is arranged on the sliding plate 23, and the second guiding slope 24 extrudes the first guiding slope 22 to move the movable pin seat 21 outwards against the resilience of the reset spring 20 when the sliding plate 23 slides to the outside of the box body 18.

A dragline is connected on an outer end of the sliding plate 23. A dragline reset spring 19 is arranged on the dragline. An end of the dragline reset spring 19 is in contact with a side wall of the outer end of the sliding plate 23. The other end of the dragline reset spring 19 is in contact with the inner wall of the box body 18. A lever 13 is connected to the upper support 1, and the lever 13 is connected to the outer end of the dragline.

The at least one group of X-shaped elevating components comprises two groups of X-shaped elevating components arranged on two sides of the upper support 1, and the two groups of X-shaped elevating components are connected by the horizontal plate 11.

A desk plate 10 is connected to the upper support 1.

The elevation working platform body comprises a keyboard holder 12 connected to the upper support 1 by a connecting plate.

As shown in FIG. 10-15, the technical solution of an eighth embodiment of the disclosure is same as the first embodiment, although a locking component 25 to restrict the sliding of the second hinging seat 6 is arranged on the lower support 2. The locking component 25 is arranged on the lower support 2 instead compared to the first embodiment.

The locking component 25 arranged on the lower support to restrict the sliding of the second hinging seat 6 comprises a first sliding rail 14 connected to the lower support 2. The second hinging seat 6 is slidably fitted on the first sliding rail 14. A plurality of positioning holes 16 are arranged along a lengthwise direction on the second hinging seat 6. A box body 18 is arranged on the lower support 2 outside the second hinging seat 6. A movable pin 17 having a free end to be inserted into or removed from the positioning holes 16 is arranged in the box body 18, and a sliding plate 23 to actuate the movable pin 17 and remove the free end of the movable pin 17 from the positioning holes 16 is slidably fitted in the box body 18.

A movable pin seat 21 is in clearance fit within the box body 18. The movable pin 17 is connected to the movable pin seat 21. A reset spring 20 is arranged on the movable pin 17. An end of the reset spring 20 is in contact with an inner wall of the movable pin seat 21. The other end of the reset spring 20 is in contact with an inner wall of the box body 18. The free end of the movable pin 17 is removed from the positioning holes 16 on the second hinging seat 6 when the reset spring 20 is compressed. A first guiding slope 22 is provided on the bottom of the movable pin seat 21. A second guiding slope 24 fitted to the first guiding slope 22 is arranged on the sliding plate 23, and the second guiding slope 24 extrudes the first guiding slope 22 to move the movable pin seat 21 outwards against the resilience of the reset spring 20 when the sliding plate 23 slides to the outside of the box body 18.

We claim:

1. An elevation working platform, comprising a elevation working platform body, the elevation working platform body having an upper support, a lower support and at least one group of X-shaped elevating components connected between the upper support and the lower support, wherein each group of X-shaped elevating components comprises a first support rod and a second support rod hinged to a central portion of each other to form an X-shape, the lower support comprises a first hinging seat fixedly connected thereto and a second hinging seat slidable relative to the lower support, the upper support comprises a third hinging seat fixedly connected thereto and a fourth hinging seat slidable relative to the upper support, a lower end of the first support rod is hinged to the first hinging seat, an upper end of the first support rod is hinged to the fourth hinging seat, a lower end of the second support rod is hinged to the second hinging seat, an upper end of the second support rod is hinged to the third hinging seat, wherein the elevation working platform comprises an elastic component, a first end of the elastic component is connected between the two endpoints of the first support rod or the second support rod, a second end of the elastic component is connected to the lower support or the second hinging seat slidable relative to the lower support, and the elastic component bears at least a part of the weight of the upper support, wherein a locking component to restrict the sliding of the second hinging seat is arranged on the lower support, and wherein the locking component arranged on the lower support to restrict the sliding of the second hinging seat comprises a first sliding rail connected to the lower support, the second hinging seat is slidably fitted on the first sliding rail, a plurality of positioning holes are arranged along a lengthwise direction on the second hinging seat, a box body is arranged on the lower support outside the second hinging seat, a movable pin having a free end to be inserted into or removed from the positioning holes is arranged in the box body, and a sliding plate to actuate the movable pin and remove the free end of the movable pin from the positioning holes is slidably fitted in the box body.

2. The elevation working platform of claim 1, wherein the elastic component is arranged between the lower support and the first support rod, the first end of the elastic component is hinged to the lower support, and the second end of the elastic component is hinged to the first support rod.

3. The elevation working platform of claim 2, wherein the elastic component is a compressed gas spring or a compressed mechanical spring.

4. The elevation working platform of claim 1, wherein the elastic component is arranged between the second hinging seat and the second support rod, the first end of the elastic component is hinged to the second hinging seat, and the second end of the elastic component is hinged to the second support rod.

5. The elevation working platform of claim 4, wherein the elastic component is a compressed gas spring or a compressed mechanical spring.

6. The elevation working platform of claim 1, wherein the elastic component is arranged between the lower support and the second support rod, the first end of the elastic component is hinged to the lower support, and the second end of the elastic component is hinged to the second support rod.

7. The elevation working platform of claim 6, wherein the elastic component is a stretch gas spring or a tension spring.

8. The elevation working platform of claim 1, wherein the elastic component is arranged between the second hinging seat and the first support rod, the first end of the elastic component is hinged to the second hinging seat, and the second end of the elastic component is hinged to the first support rod.

9. The elevation working platform of claim 8, wherein the elastic component is a stretch gas spring or a tension spring.

10. The elevation working platform of claim 1, wherein a movable pin seat is in clearance fit within the box body, the movable pin is connected to the movable pin seat, a reset spring is arranged on the movable pin, an end of the reset spring is in contact with an inner wall of the movable pin seat, the other end of the reset spring is in contact with an inner wall of the box body, the free end of the movable pin is removed from the positioning holes when the reset spring is compressed, a first guiding slope is provided on the bottom of the movable pin seat, a second guiding slope fitted to the first guiding slope is arranged on the sliding plate, and the second guiding slope extrudes the first guiding slope to move the movable pin seat outwards against the resilience of the reset spring when the sliding plate slides to the outside of the box body.

11. The elevation working platform of claim 10, wherein a dragline is connected on an outer end of the sliding plate, a dragline reset spring is arranged on the dragline, an end of the dragline reset spring is in contact with a side wall of the outer end of the sliding plate, the other end of the dragline reset spring is in contact with the inner wall of the box body, a lever is connected to the upper support, and the lever is connected to the outer end of the dragline.

12. The elevation working platform of claim 1, wherein the at least one group of X-shaped elevating components comprises two groups of X-shaped elevating components arranged on two sides of the upper support, and the two groups of X-shaped elevating components are connected by a horizontal plate.

13. The elevation working platform of claim 1, wherein a desk plate is connected to the upper support.

14. The elevation working platform of claim 13, wherein the elevation working platform body comprises a keyboard holder connected to the upper support by a connecting plate.

15. An elevation working platform, comprising a elevation working platform body, the elevation working platform body having an upper support, a lower support and at least one group of X-shaped elevating components connected between the upper support and the lower support, wherein each group of X-shaped elevating components comprises a first support rod and a second support rod hinged to a central portion of each other to form an X-shape, the lower support comprises a first hinging seat fixedly connected thereto and a second hinging seat slidable relative to the lower support, the upper support comprises a third hinging seat fixedly connected thereto and a fourth hinging seat slidable relative to the upper support, a lower end of the first support rod is hinged to the first hinging seat, an upper end of the first support rod is hinged to the fourth hinging seat, a lower end of the second support rod is hinged to the second hinging seat, an upper end of the second support rod is hinged to the third hinging seat, wherein the elevation working platform comprises an elastic component, a first end of the elastic component is connected between the two endpoints of the first support rod or the second support rod, a second end of the elastic component is connected to the lower support or the second hinging seat slidable relative to the lower support, and the elastic component bears at least a part of the weight of the upper support, wherein a locking component to restrict the sliding of the fourth hinging seat is arranged on the upper support, and wherein the locking component arranged on the upper support to restrict the sliding of the fourth hinging seat comprises a second sliding rail connected to the upper support, the fourth hinging seat is slidably fitted on the second sliding rail, a plurality of positioning holes are arranged along a lengthwise direction on the fourth hinging seat, a box body is arranged on the upper support outside the fourth hinging seat, a movable pin having a free end to be inserted into or removed from the positioning holes is arranged in the box body, and a sliding plate to actuate the movable pin and remove the free end of the movable pin from the positioning holes is slidably fitted in the box body.

16. The elevation working platform of claim 15, wherein a movable pin seat is in clearance fit within the box body, the movable pin is connected to the movable pin seat, a reset spring is arranged on the movable pin, an end of the reset spring is in contact with an inner wall of the movable pin seat, the other end of the reset spring is in contact with an inner wall of the box body, the free end of the movable pin is removed from the positioning holes when the reset spring is compressed, a first guiding slope is provided on the bottom of the movable pin seat, a second guiding slope fitted to the first guiding slope is arranged on the sliding plate, and the second guiding slope extrudes the first guiding slope to move the movable pin seat outwards against the resilience of the reset spring when the sliding plate slides to the outside of the box body.

* * * * *